US008001702B1

(12) United States Patent
Wasserman

(10) Patent No.: US 8,001,702 B1
(45) Date of Patent: Aug. 23, 2011

(54) SURF BOOT WITH PASSIVE DRAINING

(76) Inventor: Darren Wasserman, Garden Grove, CA (US)

( * ) Notice: Subject to any disclaimer, the term of this patent is extended or adjusted under 35 U.S.C. 154(b) by 821 days.

(21) Appl. No.: 12/053,963

(22) Filed: Mar. 24, 2008

Related U.S. Application Data

(63) Continuation-in-part of application No. 11/787,420, filed on Apr. 14, 2007, now Pat. No. 7,814,681.

(51) Int. Cl.
*A43B 5/08* (2006.01)

(52) U.S. Cl. ..... 36/8.1; 36/3 A

(58) Field of Classification Search ..... 36/8.1, 36/3 A; 441/61–64, 103; 137/512, 512.15, 137/854
See application file for complete search history.

(56) References Cited

U.S. PATENT DOCUMENTS 3,599,657 A * 8/1971 Maldavs ..... 137/102
4,771,555 A * 9/1988 Ohashi ..... 36/3 R
4,910,887 A * 3/1990 Turner et al. ..... 36/114
5,458,348 A * 10/1995 Lee ..... 280/11.19
6,379,203 B1 * 4/2002 Kuo ..... 441/64
6,408,540 B1 * 6/2002 DeKalb et al. ..... 36/8.1
6,551,160 B1 * 4/2003 Toth et al. ..... 441/104
6,742,287 B2 * 6/2004 DeKalb et al. ..... 36/8.1
7,107,702 B1 * 9/2006 Chavez ..... 36/3 B
7,814,681 B2 * 10/2010 Wasserman ..... 36/8.1
2004/0211085 A1 * 10/2004 Passke et al. ..... 36/3 B

* cited by examiner

*Primary Examiner* — Ted Kavanaugh
(74) *Attorney, Agent, or Firm* — Aaron Paul McGushion

(57) ABSTRACT

A double diaphragm check valve for a wetsuit boot comprising a first body disposed on said inside surface being partially inserted through said wall and having an inlet valve seat with a first diaphragm seated therein, a second body having an outlet valve seat being disposed on said outside surface and configured to hermitically connect in series to said first body sandwiching said wall therebetween with a second diaphragm seated therein, a chamber formed in said second body between said inlet valve seat configured to provide clearance for said first elastomeric diaphragm. The present check valve substantially restricts fluid flow to a direction from the inside of the boot to the environment, while preventing backflow. The present invention allows excess water to be expelled from the boot to prevent accumulation of water and the ballooning that results.

8 Claims, 3 Drawing Sheets

SURF BOOT WITH PASSIVE DRAINING

RELATED APPLICATION DATA

This application is a continuation in part of utility application Ser. No. 11/787,420 filed on Apr. 14, 2007.

BACKGROUND OF THE INVENTION

1. Field of the Invention

The present invention relates to a means to expel water from a water-sport boot during use, and more particularly, to a check valve for a wetsuit boot.

2. Description of the Related Art

Surf boots, typically made of a neoprene rubber upper with a rubber sole, are often worn in conjunction with a full neoprene wetsuit, particularly when additional protection is required against cold water temperature and/or sharp bottom conditions. A surf boot is shown in FIG. 1. The upper portion of the boot is typically a constructed of neoprene sheet material and usually this is attached to a harder rubber sole, the stiffness of which is carefully chosen to provide some protection against sharp bottom features while maintaining sufficient flexibility to allow for the freedom of motion necessary to engage in surfing or other water-sports. The upper ankle section is configured to elastically seal around the ankle, in some cases assisted by a strap as shown in the figure. The illustrated boot well-known in the field of wetsuit design, and many variations are commercially available with these common elements.

Typically, the ankle section of the boot is tucked up under the leg of the wetsuit. As the wetsuit takes on water, some of the water within the wetsuit naturally flows downward, and makes its way into the boot despite the sealing provision of most current boot designs. During the course of a surfing session, part of the time is spent standing or walking, either on the surfboard, the ocean bottom or the beach. As the boot fills up, it becomes like a water balloon around the foot, which is difficult to drain without removing the boot, often not a convenient option during the session. And of course, the boot will fill again when returned to the water as wetsuits continually take in a small amount of water by design.

All surf boots currently on the market known to the inventor exhibit this behavior. Proposed solutions have been put forth to add an active pump and valve system to surf boots, utilizing heel pumps. Although such a system may drain a boot, it is inconvenient for a number of reasons. First, the pump action of the heel is not conducive to most parts of the surfing activity. Second, surf boots become quite contaminated with sand and other debris during use, so any kind of pump is a definite reliability risk. Third, surf boots are inexpensive, long-life accessories, so a complex system is detrimental to both of these desirable attributes. To the inventor's knowledge, these disadvantages have kept active pump solutions from actually going to market.

OBJECTS OF THE INVENTION

It is an object of the present invention to provide an improved wetsuit boot that can expel excess collected water;

It is a further object of the present invention to provide an improved wetsuit boot that uses a valve means to expel the excess water; and It is a further object of the present invention to provide an improved wetsuit boot that prevents backflow of water through the valve;

These and other objects and advantages of the present invention will become apparent upon reading the following detailed description and upon reference to the accompanying drawings.

SUMMARY OF THE INVENTION

A preferred embodiment of the present invention provides double diaphragm check valve for a wetsuit boot having a wall with an inside surface on an inside and an outside surface exposed to the environment, comprising a first body disposed on the inside surface being partially inserted through the wall and having an inlet valve seat, a first elastomeric diaphragm seated within the first valve seat body and supported by the inlet valve seat forming an inlet valve, a second body having an outlet valve seat being disposed on the outside surface and configured to hermitically connect in series to the first body sandwiching the wall therebetween, a second elastomeric diaphragm seated within the second body and supported by the outlet valve seat forming an outlet valve, a chamber formed in the second body between the inlet valve seat configured to provide clearance for the first elastomeric diaphragm, the double diaphragm check valve substantially restricting fluid flow to a direction from the inside to the environment, a fluid under pressure cracking the inlet valve permitting the fluid to enter the chamber and thereafter cracking the outlet valve to permit fluid flow to the environment and substantially preventing backflow.

Preventing backflow of cold water into the boot is important for maintaining comfort and warmth while in the water. All wetsuit components, covering the body (head, feet, and hands) operate on the concept of allowing a quantity of cold water in, thereafter being warmed by the body, and trapping that warmed water between the suit and the skin. It is undesirable to unnecessarily let cold water flow back through the valve because it compromises the warmth of the foot and weighs the foot down.

So, the double check valve design not only allows excess water to flow out, it prevents the expelled water from flowing back in as the valves close due to pressure equalization with the environment. An additional benefit of the effective elimination of water is that the boot fits tightly about the foot; which is important in surfing to prevent lateral motion of the foot in maneuvers.

The double valve design also substantially prevents debris such as sand from entering the boot during use; and any debris that enters the chamber is quickly expelled with the expelling of the water.

An optional protective cover over the outlet valve with apertures formed through it can be included to protect the outlet valve diaphragm and to further prevent the entrance of large objects into the valve, such as pebbles, sticks and the like.

As can be easily imagined, the double valve of the present invention can be used on many boots or shoes of the wetsuit design, including a surfing boot, a diving boot, or a water shoe. Additionally, one or more valves can be installed on the wetsuit boot; although, for most cases, one valve is sufficient.

The simple design of the double valve does not rely on the boot design in any way for its primary function. Therefore, this valve system can be used with any existing wetsuit boot. In fact the double diaphragm check valve can be sold as an upgrade kit to be installed on a standard wetsuit boot. This kit could be sold directly to the user or sold to a surf or dive shop, where a technician can install it for the customer. This can be achieved by punching a hole through the boot wall and adhering the valve to the boot.

Although the valve can be installed anywhere on the boot body, it is preferred that the valve be installed through the wall in an area near a heel portion on the outside of the wetsuit boot. This area is preferred because the water from the wetsuit legs travels into the boot, driven there by the water head; and the valve is preferably at the bottom of the water head, but does not unnecessarily expose the extremities of the foot to the draining water. So, the heal area produces the pressure needed to expel the water through the valve, but does not force water to the toe area.

LISTING OF REFERENCE NUMERALS OF FIRST-PREFERRED EMBODIMENT

| | |
|---|---|
| double diaphragm check valve | 20 |
| wetsuit boot | 22 |
| wall | 24 |
| first body | 26 |
| inlet valve seat | 28 |
| first elastomeric diaphragm | 30 |
| fastening means | 32 |
| support | 34 |
| inlet valve | 36 |
| second body | 38 |
| outlet valve seat | 40 |
| support | 42 |
| second elastomeric diaphragm | 44 |
| chamber | 46 |
| fastening means | 48 |
| protective cover | 50 |
| apertures | 52, 54,56 |
| outlet valve | 58 |
| inner flange | 60 |
| outer flange | 62 |
| annular wall | 64 |
| socket | 66 |

DESCRIPTION OF THE PREFERRED EMBODIMENTS

Figure 1:
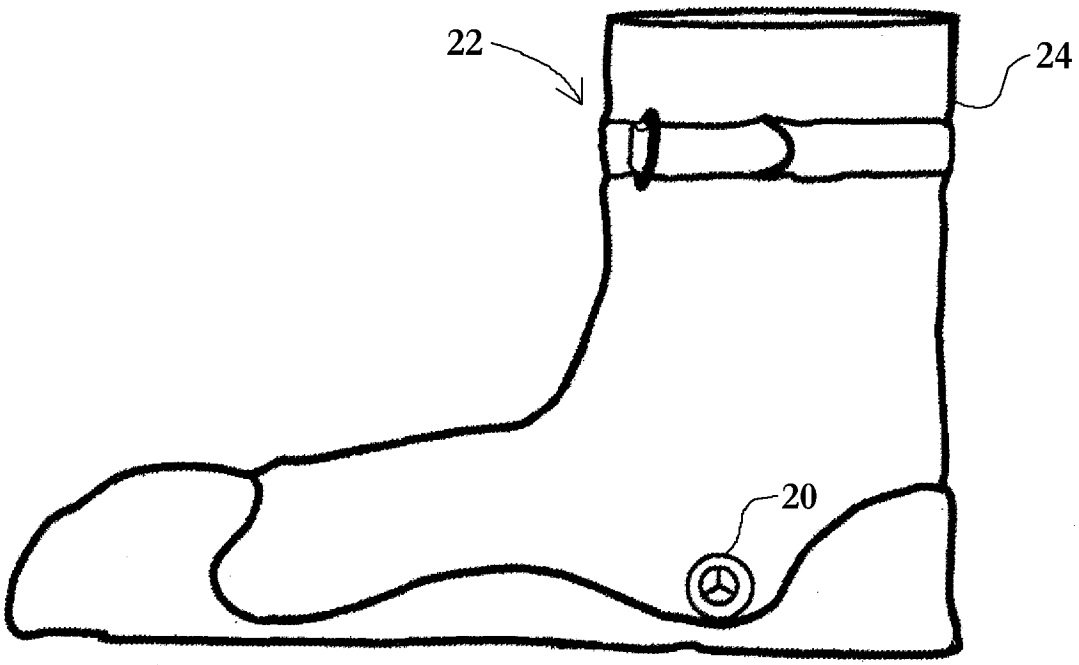
FIG. 1 is a plan view of the preferred embodiment of the present invention, showing the double diaphragm check valve installed on a wetsuit boot.
Figure 2:
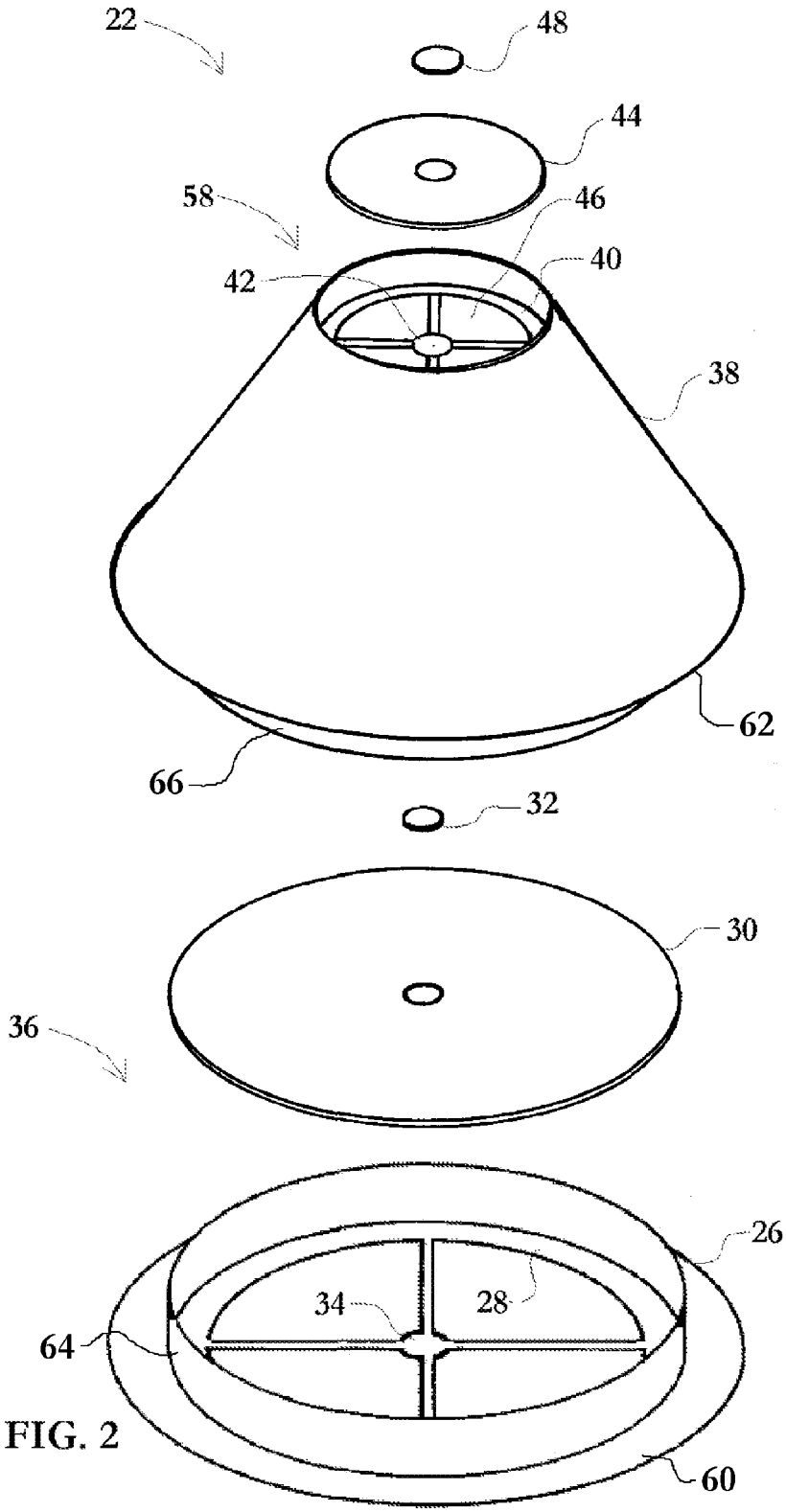
FIG. 2 is an exploded perspective view of the preferred embodiment, showing the double diaphragm check valve.
Figure 3:
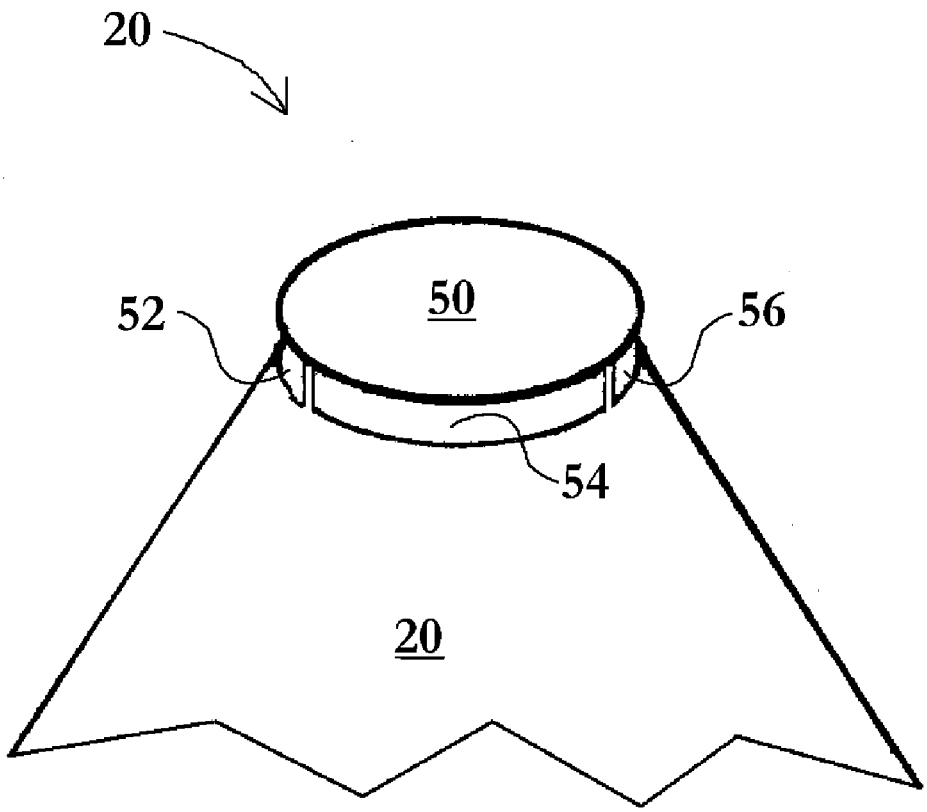
FIG. 3 is a partial perspective view of the outlet region of the double diaphragm check valve showing the optional protective cover.

Preferred and alternate embodiments of the wetsuit valve of the present invention are shown in FIGS. 1-3 in exemplary form and may be varied without affecting the inventive function of the device. Looking at FIG. 1, a standard wetsuit boot 22 is shown. As mentioned previously, any boot or shoe for water sports that experiences the problem of collected water being stored within may benefit from the installation of the presented valve system. One double diaphragm check valve 20 is shown installed through the wall 24 of the wetsuit boot 22. More than one double diaphragm check valve 20 may be installed as necessary; however, only one per boot is usually needed, due to the efficient and effective expulsion of water through just the one. The placement of the double diaphragm check valve 20 on the outsole side of the wetsuit boot 22 insures that the double diaphragm check valve 20 will not interfere with activities.

Now turning to FIG. 2, the double diaphragm check valve 20 is shown in an exploded view. A hole (not shown) can be punched through a standard neoprene boot in preparation to receive the double diaphragm check valve 20. The annular wall 64 of the first body 26 is pushed through the hole from the inside of the boot, the annular wall 64 having a diameter that is complementary to the hole or slightly larger and a height that is complementary to the thickness of the wall 24. The inner flange 60 remains on the inside of the boot 22, while the annular wall 64 protrudes into the hole. An adhesive can be applied to the area to secure the inner flange 60 to the inside of the wall 24.

Formed within the first body 26 is an inlet valve seat 28 with a support 34 spanning the opening to provide support for the first elastomeric diaphragm 30, being secured to the support 34 by the fastening means 32. The support 34 prevents the first elastomeric diaphragm 30 from being pulled into the interior of the boot 22 and compromising the seal. The support 34 could be a cross structure as shown, or any number of supports that allow water to pass and restrict the first elastomeric diaphragm 30 to opening in a single direction, including a screen and such. The combination of the first body 26 and the first elastomeric diaphragm 30 provide the inlet valve 36 assembly.

The second body 38 is installed from the outside of the boot 22, the socket 66 being inserted through the hole and connecting with the annular wall 64 of the first body 26. The design of the second body 38 is such so that it does not interfere with the opening of the first elastomeric diaphragm 30, the chamber 46 within providing sufficient clearance for proper function. Again, adhesive can be used to secure the outer flange 62 to the boot 22 and the socket 66 to the annular wall 64, providing sufficient sealing. Downstream of the chamber 46 is the outlet valve seat 40 with a support 42 being similar in design to the support 34. A second elastomeric diaphragm 44 is secured to the support 42 by fastening means 48. Together the second elastomeric diaphragm 44, the valve seat 40, and the support 42 form the outlet valve 58.

Water under pressure cracks the inlet valve 36 and travels into the chamber 46, thereafter cracking the outlet valve 58 to exit to the environment. As the interior water pressure reduces upon expulsion, the elastic property of the boot tends to squeeze out the remaining water, creating a slight suction, where the pressure of in the interior is slightly less than the environment. For a single stage valve assembly, there world be a tendency for water to rush back into the boot 22 before the valve is able to fully seat and seal. The design of the double diaphragm check valve 20 in the present invention helps to significantly prevent the backflow of water by placing the inlet valve 56 in series with the outlet valve 58. This additionally protects the inlet valve 36 from contamination from foreign debris.

FIG. 3 shows an alternate embodiment where a protective cover 50 is formed over the outlet valve 58 to provide protection. There are several apertures 52, 54, 56 that permit the water to flow out, but prevent large debris form entering the double diaphragm check valve 20. Although a solid cap is shown, other equivalents could be a screen or any number of structures that permit water flow an prevent entry of debris, such as sticks and such.

While particular forms of the invention have been illustrated and described, it will also be apparent to those skilled in the art that various modifications can be made without departing from the spirit and scope of the invention. Accordingly, it is not intended that the invention be limited except by the claims.

What is claimed is:

1. A double diaphragm check valve for a wetsuit boot having a wall with an inside surface on an inside and an outside surface exposed to the environment, comprising:

a first body disposed on said inside surface being partially inserted through said wall and having an inlet valve seat;

a first elastomeric diaphragm seated within said first valve seat body and supported by said inlet valve seat forming an inlet valve;

a second body having an outlet valve seat being disposed on said outside surface and configured to hermitically connect in series to said first body sandwiching said wall therebetween;

a second elastomeric diaphragm seated within said second body and supported by said outlet valve seat forming an outlet valve, a chamber formed in said second body between said inlet valve seat configured to provide clearance for said first elastomeric diaphragm;

said double diaphragm check valve substantially restricting fluid flow to a direction from said inside to the environment, a fluid under pressure cracking said inlet valve permitting said fluid to enter said chamber and thereafter cracking said outlet valve to permit fluid flow to the environment and substantially preventing backflow.

2. The double diaphragm check valve of claim 1 further comprising a protective cover over said outlet valve having apertures formed through to permit the outflow of said fluid while substantially preventing entrance of foreign objects.

3. The double diaphragm check valve of claim 1 wherein said wetsuit boot is one of a surfing boot, a diving boot, or a water shoe.

4. The double diaphragm check valve of claim 1 wherein a single double diaphragm check valve is installed on said wetsuit boot.

5. The double diaphragm check valve of claim 1 wherein a plurality of double diaphragm check valves are installed on said wetsuit boot.

6. The double diaphragm check valve of claim 1 wherein said double diaphragm check valve is sold as an upgrade kit to be installed on a standard wetsuit boot.

7. The double diaphragm check valve of claim 1 wherein said double diaphragm check valve is installed through said wall in an area near a heel portion on an outside of said wetsuit boot.

8. A double diaphragm check valve for a wetsuit boot having a wall with an inside surface on an inside and an outside surface exposed to the environment, comprising:

a first body disposed on said inside surface being partially inserted through said wall and having an inlet valve seat;

a first elastomeric diaphragm seated within said first valve seat body and supported by said inlet valve seat forming an inlet valve;

a second body having an outlet valve seat being disposed on said outside surface and configured to hermitically connect in series to said first body sandwiching said wall therebetween;

a second elastomeric diaphragm seated within said second body and supported by said outlet valve seat forming an outlet valve, a chamber formed in said second body between said inlet valve seat configured to provide clearance for said first elastomeric diaphragm;

a protective cover over said outlet valve having apertures formed through to permit the outflow of a fluid while substantially preventing entrance of foreign objects;

said double diaphragm check valve substantially restricting fluid flow to a direction from said inside to the environment, said fluid under pressure cracking said inlet valve permitting said fluid to enter said chamber and thereafter cracking said outlet valve to permit fluid flow to the environment and substantially preventing backflow.

* * * * *